United States Patent [19]

Benin et al.

[11] Patent Number: 4,848,917

[45] Date of Patent: Jul. 18, 1989

[54] AUTOMATIC VORTEX MIXER

[75] Inventors: Joshua Benin, Newark, Del.; William G. Di Maio, Brookhaven, Pa.; Carl F. Morin, Brandywood, Del.

[73] Assignee: E. I. Du Pont de Nemours and Company, Wilmington, Del.

[21] Appl. No.: 237,254

[22] Filed: Aug. 26, 1988

[51] Int. Cl.[4] ..... B01F 11/00

[52] U.S. Cl. ..... 366/208; 366/110; 366/111; 422/99

[58] Field of Search ..... 366/110, 111, 112, 125, 366/128, 208–217, 601, 602; 422/99, 104; 494/16; 74/86

[56] References Cited

U.S. PATENT DOCUMENTS

| | | | |
|---|---|---|---|
| 2,116,367 | 5/1938 | Smith | 366/110 |
| 3,061,280 | 10/1962 | Kraft et al. | 366/110 |
| 3,159,384 | 12/1964 | Davis | 366/112 X |
| 4,555,183 | 11/1985 | Thomas | 366/208 |

*Primary Examiner*—Timothy F. Simone

[57] ABSTRACT

A vortexing mixer drive has a rotatable coupling rod where an end face defines an offcenter countersink with a bore at the center of the countersink. The rod is axially displaced to engage a vessel's protuberant tip to effect rotational movement.

4 Claims, 2 Drawing Sheets

AUTOMATIC VORTEX MIXER

CROSS-REFERENCE TO RELATED APPLICATIONS

Subject matter disclosed herein is disclosed or claimed in the following copending applications filed contemporaneously herewith:

Vortexing Liquid Container, filed 08/26/88, Ser. No. 07/237,589 (IP-753);

Vortex Mixer Drive, filed 08/24/88, Ser. No. 07/237/017 (IP-752); and

Lid Structure, filed 08/26/88, Ser. No. 07/237,011 (IP-725).

FIELD OF THE INVENTION

The present invention relates to a noninvasive method for mixing fluids contained within a container or compartment. In particular, the device of this invention is a coupling which enables a vessel to be engaged and orbited automatically.

BACKGROUND OF THE INVENTION

It is known that creating a vortex in a container is an effective means for mixing its contents. Common laboratory vortexers use a support cup or a resilient container receiving surface mounted eccentrically on a motor in order to translate the lower end of a container in a circular path or orbit at a high speed and thereby create an effective vortex in the fluid held by the container. Exemplary of this type of device are those disclosed in U.S. Pat. Nos. 4,555,183 (Thomas) and 3,850,580 (Moore et al.). These devices are manual in that an operator is required to hold the vessel in contact with the eccentrically movable means to create the vortex in the fluid disposed in the container.

Thomas discloses the use of an eccentrically rotating cylinder having a cup to receive the lower portion of a laboratory test tube in a V-shaped depression. The tube can only be removed or inserted into the cup by lifting or lowering the tube.

Such vortex type device would be extremely advantageous in an automated chemical analysis instrument as it is not invasive and therefore avoids the concern of contamination associated with an improperly cleaned invasive mixing means. A device the incorporates this type of mixing into an automated testing apparatus is disclosed in an article by Wada et al. entitled "Automatic DNA Sequencer: Computer Program MIcro Chemical Manipulator for the Maxim-Gilbert Sequencing Method," Review of Scientific Instruments 54 (11), Nov. 1983, pages 1569–1572. In the device disclosed in this article, a plurality of reaction vessels are held flexibly in a centrifuge rotor. A rotational vibrator is mounted on a vertically moving cylinder. When mixing is desired the reaction vessel is positioned in a mixing station directly above the rotational vibrator. The vertically moving cylinder is moved upwardly to contact the bottom of the reaction vessel with the rotary vibrating rubber portion of the rotational vibrator. The vibrating rubber portion is V-shaped in cross-section to engage a test tube having a V-shaped bottom. The eccentric drive for this rotational vibrator is mounted on a bearing and requires a rotation inhibitor coupling to be used.

This type of device is not always satisfactory in that the drive mechanism is more complex than is needed and also the test tubes must be quite securely and yet flexibly mounted so as to permit their movement without slipping out of the drive mechanism.

Vortex mixing is desirable in most automated chemical analyzers, as stated above, and can become necessary when solid supports such as glass beads or magnetic particles are used. Such particles often have a tendency to sink to the bottom of the reaction vessel. For example, in heterogeneous immunoassays, magnetic particles can be used as a basis for separation of the reagents from ligand-antibody bound particles. A particularly desirable particle for such use is the chromium dioxide particle which is disclosed in U.S. Pat. No. 4,661,408 (Lau et al.). These particles have a tendency to settle at a rate which can result in non-uniform sample or reagent mixture. It is therefore desirable that the reagents and/or reaction mixtures be mixed regularly prior to reagent withdrawal.

SUMMARY OF THE INVENTION

A relatively simple, inexpensive, yet effective, vortex mixer for use in an automatic chemical analyzer is the subject of this invention. Thus a vortexing mixer for an automatic chemical analyzer apparatus establishes a vortex in liquid materials contained in elongated compartments, each compartment having a longitudinal axis, disposed on a transport, the apparatus comprising a plurality of compartment carriers disposed on the transport, each carrier adopted to hold flexibly the upper portion of a compartment, the transport having a path of movement, each compartment having a protuberant tip lying on the compartment longitudinal axis, a rotatable coupling having an axis of rotation and an end face transverse to the axis of rotation and located under a region on the path of movement of the transport, means for displacing the coupling along the axis of rotation to engage the protuberant tip by the end face, the end face of the coupling defining a countersink the center of which is off of the axis of rotation, the end face of the coupling also defining a bore in the countersink adapted to receive the protuberant tip, whereby when the coupling is rotated and displaced to contact the protuberant tip, the tip is translated radially along the face of the coupling by the countersink to be engaged by the bore and orbited.

Preferably the countersink includes the axis of rotation and defines an acute angle with the face of the coupling. Also it is preferred that the bore have a peripheral edge lying at the center of the countersink.

With this apparatus, the countersink, which is in the form of a crater-like depression in the face of the coupling, acts to guide the stem end of the container into a drive hole or bore formed in the end face of the coupling. The hole must be located so as to include the axis or center of the countersink such that when the coupling is translated to contact the stem end of a compartment, the rotating coupling engages the stem end. When the top portion of the container is flexibly mounted this nutational or orbital movement created at the bottom of the container creates a liquid vortex within the compartment to establish the desired mixing.

BRIEF DESCRIPTION OF THE DRAWINGS

The invention may be more fully understood from the following detailed description thereof taken into connection with the accompanying drawings which form a part of this invention description and in which similar reference numbers refer to similar elements in all figures of the drawings in which.

DETAILED DESCRIPTION OF THE PREFERRED EMBODIMENT

Figure 1:
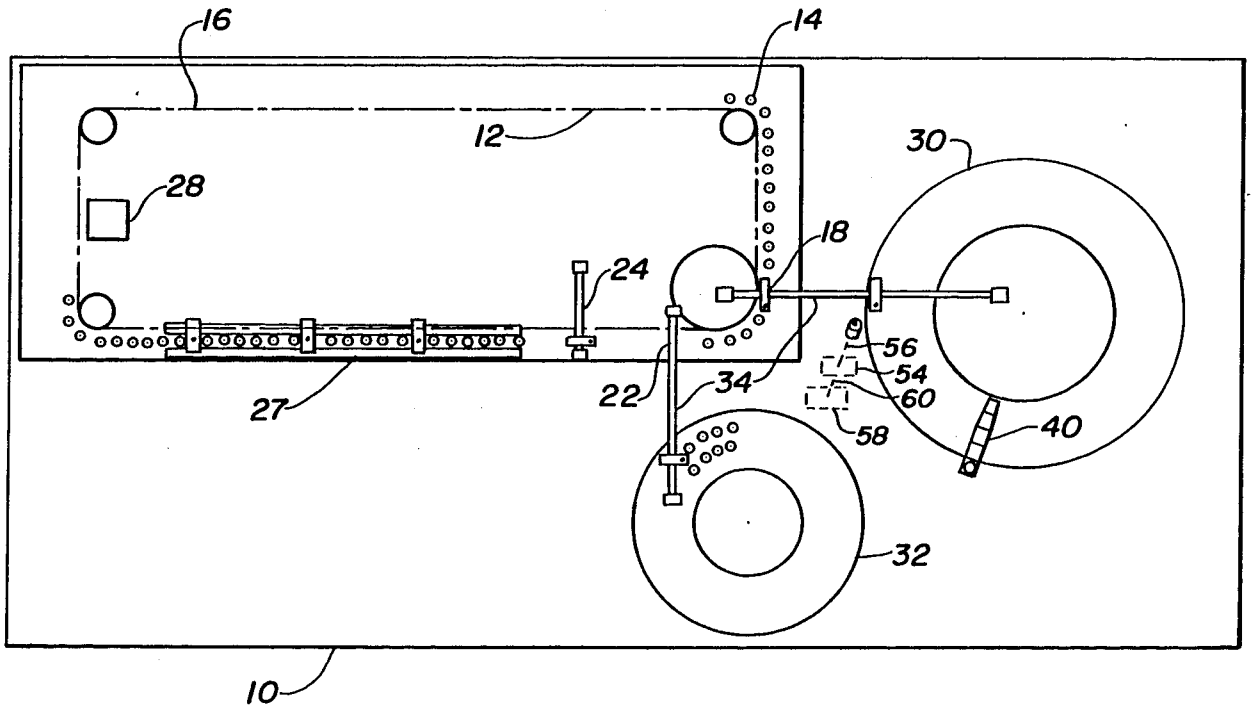
FIG. 1 is a plan view of the processing chamber of a chemical analysis instrument using a chain transport for the reaction vessels and a disc support for sample containers having a compartment with which the non-invasive vortex mixing drive of this invention may be used.

Chemical analyzer instrument in which the non-invasive mixing apparatus of this invention might be used is seen in FIG. 1. The analyzer, which may be conventional, includes a processing chamber 10 with a drive assembly 12 which is operable to translate individual reaction vessels 14 in a serial fashion to various processing stations 16 located within the processing chamber. The processing chamber includes a reagent loading station 18, a sample dispensing station 22, a wash station 24, a mixing station 27, a measuring station 28, a reagent disc 30 for holding sample container strips 40, a sample carousel 32, and transfer arms 34 for transferring sample and reagents to the reaction vessels 14.

Figure 2:
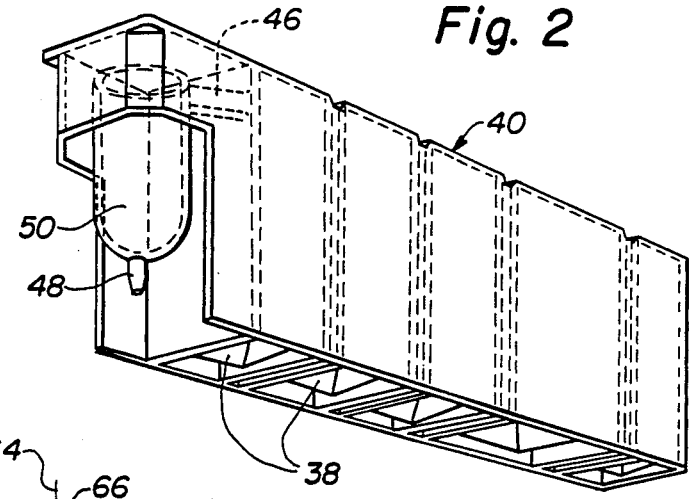
FIG. 2 is an isometric view of a reagent container having multiple compartments that may be used with the vortexing coupling of this invention.
Figure 3:
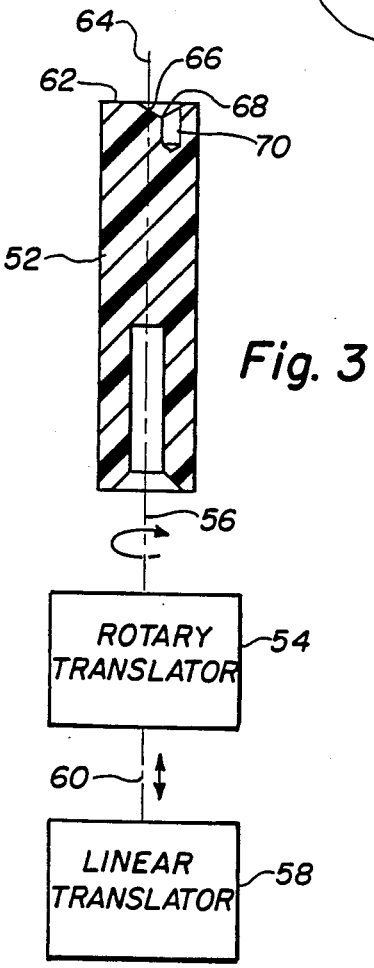
FIG. 3 is a block schematic diagram of the vortex coupling mechanism used with this invention.
Figure 4:
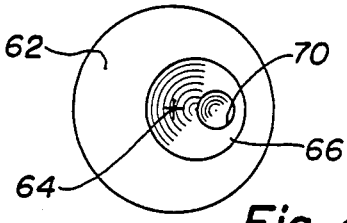
FIG. 4 is a top view of the end face of the coupling mechanism of FIG. 3.

The reagent disc 30 is adapted to hold a number of multi-comparted container strips 40. A preferred container strip for this purpose is that described in the copending application of DiMaio et al. entitled Vortexing liquid container. This container strip, as is described in the DiMaio et al. application, and as may be seen in FIG. 2, has a plurality of containers 38 arranged in an endto-end relationship to form a container strip 40. As is described in U.S. Pat. No. 4,720,734 issued Jan. 19, 1988 to Ramachandran, the container strip 40 may be fabricated in any convenient manner. In the embodiment shown, the container strip includes a rigid peripheral band 36 formed of a suitable material such as an inert plastic. The band is either joined to or formed integrally with each of the containers 38 such that in the preferred case the container strip generally tapers in a substantially elongated wedge-like manner from a first edge to a second edge. This wedge-shaped plan profile for the container strip facilitates the mounting of a plurality of such strips 40 in a circumferentially adjacent, generally radially extending in relationship across the rotatable reagent disc 30 plate. It should be appreciated however that the individual containers 38 may take any predetermined configuration and may be used alone or arranged together in any convenient number and remain within the contemplation of this invention.

Each of the containers whether arranged singularly or in a container strip 40 is formed of a suitable inert plastic material and includes a compartment defined by generally opposed pairs of generally parallel and integrally formed sidewalls and endwalls. The upper surfaces of the sidewalls and the endwalls together with the upper surface of the band and the vicinity thereof define a substantially planar sealing surface 41 peripherally surrounding the open upper end of the containers. Each of the containers typically may be closed by a downwardly sloping inverted pyramidal floor. In the preferred embodiment, the sidewalls of each container except for the vortex compartment are joined to the peripheral band. The band extends slightly below the lower ends of the containers and thus defines the support structure whereby the inner strip may be set on a suitable work face. The several containers 38 may be arranged in various configuration square, rectangle, etc.

Each of the adjacent containers 38 are spaced from each other by a predetermined gap to enhance the thermal and vapor isolation of the containers. Preferably the container strip 40 is formed by injection molding and is formed of polypropylene. Alternatively polyethylene or other suitable materials of construction may be used, however polypropylene is preferred because of its ability to be flexed many times and not break.

The end container or compartment 50 is tubular and elongated and has a longitudinal axis. The vessel also has a rim which defines a peripheral mounting surface 41 similar to the peripheral mounting surfaces provided by the containers and the band. The compartment 50 is connected to the band only by an integral thin finger of plastic 46 which forms a flexible hinge. The flexible hinge is directed to a corner formed by the band and the container adjacent the end. The plastic finger 46 is located just below the rim such that it does not interfere with a vapor seal which is placed on top of the compartment and the containers.

The bottom of the compartment 50 is formed to have a downwardly extending protuberant tip portion 48 with is adapted to being engaged by an eccentric or orbiting type drive to create nutational movement of the bottom portion of the compartment 50, the compartment 50 pivoting about the flexible hinge 46. The band forms a short skirt about the compartment 50 such that the compartment 50 is free for such nutational movement of its lower portion.

While the containers may be left open if desired, when reagents are stored therein it is best that a vapor barrier and rehealable lid be used to afford plural piercing by a probe for withdrawal of the reagents. For this reason, as is described in the copending DiMaio et al. application, a suitable laminate may be heat sealed to the top rim of each of the compartments and containers in the sample strip 40. This may be a three ply laminate covered by an elastomeric self-healing structure such as silicone rubber. The laminate is constructed with an outer layer of polyester film, a polyvinyldene chloride coating on the polyester film and an outer barrier sheet of polypropylene. This three ply sheet is slit immediately around the rim of the compartment to facilitate the nutational movement of the bottom of the compartment 50.

According to this invention, an automatically engageable nutator drive is provided for the compartment 50. This drive includes a coupling rod 52 which is rotated by a rotary translator 54, such as a stepping motor, operating through a drive coupling 56. The rotary translator itself is mounted so as to be driven by a linear translator 58 operating through the linkage 60 to move the coupling 52 up to contact the protuberant tip 48.

The end face 62 of the coupling rod 52 has an axis of rotation 64 and a countersink 66 formed therein. The center or axis 68 of the countersink 66 is further formed by a bore 70. The bore 70 must include the center 68 of the countersink. In like manner the countersink must be off-axis but yet must include the axis 64 of the coupling rod 52. The angle that the countersink forms with the end face 62 must be an acute angle and preferably in the order of magnitude of 30. Also preferably the peripheral edge of the bore 70 will lie right on the center 68 of the countersink.

Figure 5:
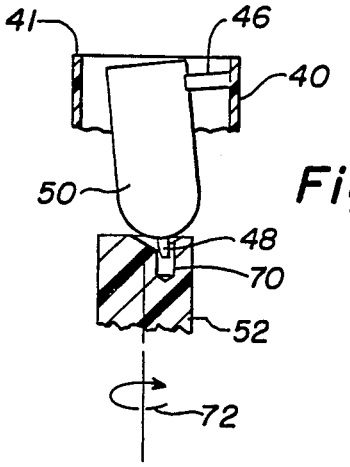
FIG. 5 is a fragmentary side elevation view partly in cross-section, depicting the operation of the coupling mechanism of FIGS. 3 and 4.

In its operation, as seen most clearly in FIG. 5, the compartment 50 which is part of the strip 40 is mounted to the strip 40 at its upper portion by the hinge 46. The coupling 52 is moved upwardly while rotating as depicted by the arrow 72 until the protuberant tip 48 is engaged by the countersink which directs the tip 48 into the bore 70. The utilization of the bore 70 provides a sure, firm contact on the protuberant tip such that little upward pressure need be applied to the compartment 50 to effect the nutational rotation of the bottom of the compartment. The coupling device is thus an effective sure way of effecting the nutational movement.

The coupling 52 may be constructed of any suitable material. Preferably a plastic material is used. Any of the suitable engineering plastics may be used; however, it is preferred that ABS plastic sold under the trade name cycolac X-17 be used.

What is claimed is:

1. An automatic apparatus for establishing a vortex in liquid materials contained in elongated compartments, each compartment having a longitudinal axis, disposed on a transport comprising:

a plurality of compartment carriers disposed on the transport, each carrier adapted to hold flexibly the upper portions of the compartment, the transport having a path of movement, each compartment having a protuberant tip at the bottom of the vessel lying on the longitudinal axis, a rotatable coupling having an axis of rotation, an end face transverse to the axis rotation, and located under a region in the path of movement of the compartment carriers, means for displacing the coupling along the axis of rotation to engage the protuberant tip by the end face, the end face of the coupling defining a countersink the center of which is off of the axis of rotation, the end face of the coupling also defining a bore in the countersink adapted to receive the protuberant tip, whereby when the coupling is rotated and displaced to contact the protuberant tip, the tip is translated radially along the face of the coupling by the countersink to be engaged by the bore and orbited.

2. The apparatus set forth in claim 1 wherein the countersink includes the axis of rotation.

3. The apparatus set forth in claim 2 wherein the countersink defines an acute angle with the face of the coupling.

4. The apparatus set forth in claim 2 wherein the bore has a peripheral edge lying at the center of the countersink.

* * * * *